US011359378B2

(12) United States Patent
Mischker

(10) Patent No.: US 11,359,378 B2
(45) Date of Patent: Jun. 14, 2022

(54) SYSTEMS AND METHODS RELATED TO LIQUID DRAINAGE

(71) Applicant: Tri-Step Gutter Covers, Inc., Pewaukee, WI (US)

(72) Inventor: Patrick J. Mischker, Pewaukee, WI (US)

( * ) Notice: Subject to any disclaimer, the term of this patent is extended or adjusted under 35 U.S.C. 154(b) by 0 days.

(21) Appl. No.: 17/188,484

(22) Filed: Mar. 1, 2021

(65) Prior Publication Data

US 2021/0270041 A1 Sep. 2, 2021

Related U.S. Application Data

(60) Provisional application No. 62/983,942, filed on Mar. 2, 2020.

(51) Int. Cl.
*E04D 13/076* (2006.01)

(52) U.S. Cl.
CPC ..... *E04D 13/076* (2013.01)

(58) Field of Classification Search
CPC ..... E04D 13/076; E04D 13/0765; E04D 13/0725; E04D 13/0445; E04D 13/064; E04D 13/0641; E04D 13/0643; E04D 13/068; E04D 13/0685; E04D 13/072
See application file for complete search history.

(56) References Cited

U.S. PATENT DOCUMENTS 5,067,675 A * 11/1991 Brant ..... E04D 13/0725 248/48.2
5,617,678 A * 4/1997 Morandin ..... E04D 13/0725 52/12
5,845,435 A * 12/1998 Knudson ..... E04D 13/0725 248/48.1
6,701,674 B1 * 3/2004 Albracht ..... E04D 13/076 52/12
6,993,870 B2 * 2/2006 McDonald ..... E04D 13/0481 52/12
7,117,643 B2 10/2006 Brown
7,506,476 B2 3/2009 McDonald
7,584,576 B2 * 9/2009 McDonald ..... E04D 13/076 52/12
7,650,720 B2 1/2010 Ealer, Sr.
7,752,812 B2 * 7/2010 Knudson ..... E04D 13/076 52/12
8,176,687 B2 5/2012 Roque
8,579,238 B2 11/2013 Jones
8,677,695 B2 3/2014 McCoy
8,689,819 B2 4/2014 Hashimoto
8,756,868 B2 6/2014 McCoy
8,997,403 B1 4/2015 Steinberg
9,683,371 B1 6/2017 Nitch
(Continued)

*Primary Examiner* — Babajide A Demuren
(74) *Attorney, Agent, or Firm* — Smith Keane LLP

(57) ABSTRACT

Systems and methods for draining liquids include spaced support members and drainage ribs extending therebetween. Adjacent rows of drainage ribs may establish a general checkerboard pattern of ribs and interstitial spaces therebetween. Drainage ribs may have a differential height along their length, though may have substantially coplanar bottom surfaces. A first support member is provided with stress risers to enable enhanced bending capability to provide a customizable device width for mating with predetermined liquid conduit sizes, such as roofing gutters having upward-facing channel widths.

5 Claims, 8 Drawing Sheets

(56) References Cited

U.S. PATENT DOCUMENTS

| | | | | |
|---|---|---|---|---|
| 10,443,244 | B2 | 10/2019 | Gori | |
| 10,513,852 | B2 | 12/2019 | Gori | |
| 10,633,867 | B2 | 4/2020 | Gori | |
| 10,633,868 | B2 | 4/2020 | Gori | |
| D885,529 | S | 5/2020 | Gori | |
| D885,530 | S | 5/2020 | Gori | |
| D885,531 | S | 5/2020 | Gori | |
| 10,655,332 | B2 | 5/2020 | Gori | |
| 10,655,333 | B2 | 5/2020 | Gori | |
| 10,655,334 | B2 * | 5/2020 | Gori | E04D 13/076 |
| 11,174,642 | B2 * | 11/2021 | Miller | E04D 13/064 |
| 2004/0000098 | A1 * | 1/2004 | Knudson | E04D 13/0725 52/12 |
| 2009/0235592 | A1 * | 9/2009 | Knudson | E04D 13/0725 52/12 |
| 2013/0248672 | A1 * | 9/2013 | Martin | E04D 13/064 248/312.1 |
| 2021/0246659 | A1 * | 8/2021 | Miller | E04D 13/076 |

* cited by examiner

SYSTEMS AND METHODS RELATED TO LIQUID DRAINAGE

BACKGROUND OF THE INVENTION

Management of waste liquid and/or liquid runoff is of utmost importance in modern society. Displaced, blocked, or backed-up liquid can cause real and personal property damage, and even injury, through erosion, corrosion, or simply absorption tending towards rot or fungus invasion. For instance, extensive efforts are undertaken in the development of new residential neighborhoods and business parks to ensure that environmental runoff is directed and contained for further natural or artificial treatment. Likewise, industrial and interior liquid drains assist in managing and conveying spilled or used liquid to holding tanks or other liquid treatment systems.

Prior devices have been developed in an effort to allow liquid to pass but to block obstructive articles from entering a liquid conduit. Such devices may be referred to generally as grates, screens, covers, etc. Improvements to prior drainage devices are desirable to improve liquid drainage and attempt to minimize or eliminate blockage or obstruction thereof.

SUMMARY OF THE INVENTION

Embodiments of systems and methods according to the present invention relate generally to liquid drainage, and more particularly to improved passive liquid drainage grates.

An embodiment of a device according to the present invention includes a first support member having a first support member length, and a second support member spaced at least substantially equidistant from the first support member along at least a majority of the first support member length. A first plurality of spaced drainage ribs extend from the first support member towards the second support member, and a second plurality of spaced drainage ribs extending from the second support member towards the first support member. A third plurality of spaced drainage ribs extend between and are coupled to the first plurality of drainage ribs and the second plurality of drainage ribs.

According to an aspect of an embodiment of a device according to the present invention, the third plurality of drainage ribs is longitudinally offset from at least one of the first plurality of drainage ribs and the second plurality of drainage ribs. Such offset may create an alternating checkerboard pattern of ribs and spaces. The first plurality of drainage ribs and the second plurality of drainage ribs may be longitudinally aligned.

According to another aspect of an embodiment of a device according to the present invention, each drainage rib may include a bottom surface that is coplanar with a bottom surface of every other drainage rib.

According to a further aspect of an embodiment of a device according to the present invention, each rib may extend from a rib first end to a rib second end, having a rib height, wherein the rib height measured at the rib first end may be different than the rib height measured at the rib second end.

According to still another aspect of an embodiment of a device according to the present invention, each respective rib first end may be positioned closer to the first support structure than each respective rib second end and the rib height measured at the rib first end may be less than (e.g., shorter than) the rib height measured at the rib second end.

According to yet another aspect of an embodiment of a device according to the present invention, the device may further include a drainage channel having an open top and a free edge, wherein the second support member is secured to the free edge continuously (e.g., with adhesive) and/or at one or more attachment locations (e.g., with adhesive or with mechanical fasteners, such as screws). Such drainage channel may be a gutter secured to a building facia.

According to still a further aspect of an embodiment of a device according to the present invention, the device may have an overall rectangular or circular shape.

According to yet a further aspect of an embodiment of a device according to the present invention, at least one spacing rib (and more preferably two spacing ribs) may be located and extending between at least two adjacent drainage ribs, and preferably at least one spacing rib is provided between all adjacent drainage ribs. The spacing ribs are preferably substantially evenly distributed along the length of the adjacent drainage ribs.

According to another embodiment of a device according to the present invention, the device includes a first support member having a first support member length and a second support member spaced at least substantially equidistant from the first support member along at least a majority of the first support member length. A support beam preferably extends along a support beam length and spaced at least substantially equidistant from the first support member along at least a majority of the first support member length. The support beam is preferably located between and spaced from the first support member and the second support member. A first plurality of drainage ribs extending from the first support member to the support beam, a majority of the first plurality of drainage ribs having an upper surface extending from a first end coupled to the first support member to a second end coupled to the support beam. A second plurality of drainage ribs extending from the support beam to the second support member, a majority of the second plurality of drainage ribs having an upper surface extending from a first end coupled to the support beam to a second end coupled to the second support member. The second end of the upper surface of the majority of the first plurality of drainage ribs terminates in a knee that is positioned at a greater distance from the support beam than the first end of the upper surface of the majority of the second plurality of drainage ribs. In an optional configuration, the support beam is replaced with a pair of spaced support beams and a third plurality of drainage ribs extending therebetween. In this fashion, the first plurality of drainage ribs extends from the first support member to a first of the support beams and the second plurality of drainage ribs extends from a second of the support beams to the second support member, and the third plurality of drainage ribs (which may be laterally offset from the first plurality and/or second plurality) extends from the first support beam to the second support beam.

An embodiment of a method according to the present invention includes the steps of positioning a grate over a gutter positioned to receive liquid drainage from a roof and securing the grate relative to the gutter. The grate preferably includes a first support member having a first support member length and a second support member spaced at least substantially equidistant from the first support member along at least a majority of the first support member length. The grate further preferably includes a first plurality of spaced drainage ribs extending from the first support member towards the second support member and a second plurality of spaced drainage ribs extending from the second support member towards the first support member. The grate also preferably includes a third plurality of spaced drainage ribs extending between and coupled to the first plurality of drainage ribs and the second plurality of drainage ribs.

According to an aspect of an embodiment of a method according to the present invention, the positioning step may include the step of inserting the first support member between components of the roof, such as under one or more layers of asphalt shingles. In this way, the first support member may not need to be fastened, adhered, or otherwise additionally secured relative to the roof and/or gutter. Thus, the method may further include the step of refraining from coupling the first support member (e.g., to a roof, facia, and/or gutter) with a mechanical fastener.

According to another aspect of an embodiment of a method according to the present invention, the positioning step may include the steps of bending the first support member and inserting the first support member into the gutter. The first support member may thereafter and/or also be coupled to the gutter and/or facia and/or roof with a mechanical fastener, such as a screw.

According to still another aspect of an embodiment of a method according to the present invention, the first support member may include at least one stress riser formed along and parallel to the first support member length, the bending step comprising the step of deforming the first support member along one of the at least one stress riser. The stress riser (e.g., continuous or intermittent groove) may be formed along a portion of the first support member length or the entirety thereof.

DESCRIPTION OF THE PREFERRED EMBODIMENT

Figure 1:
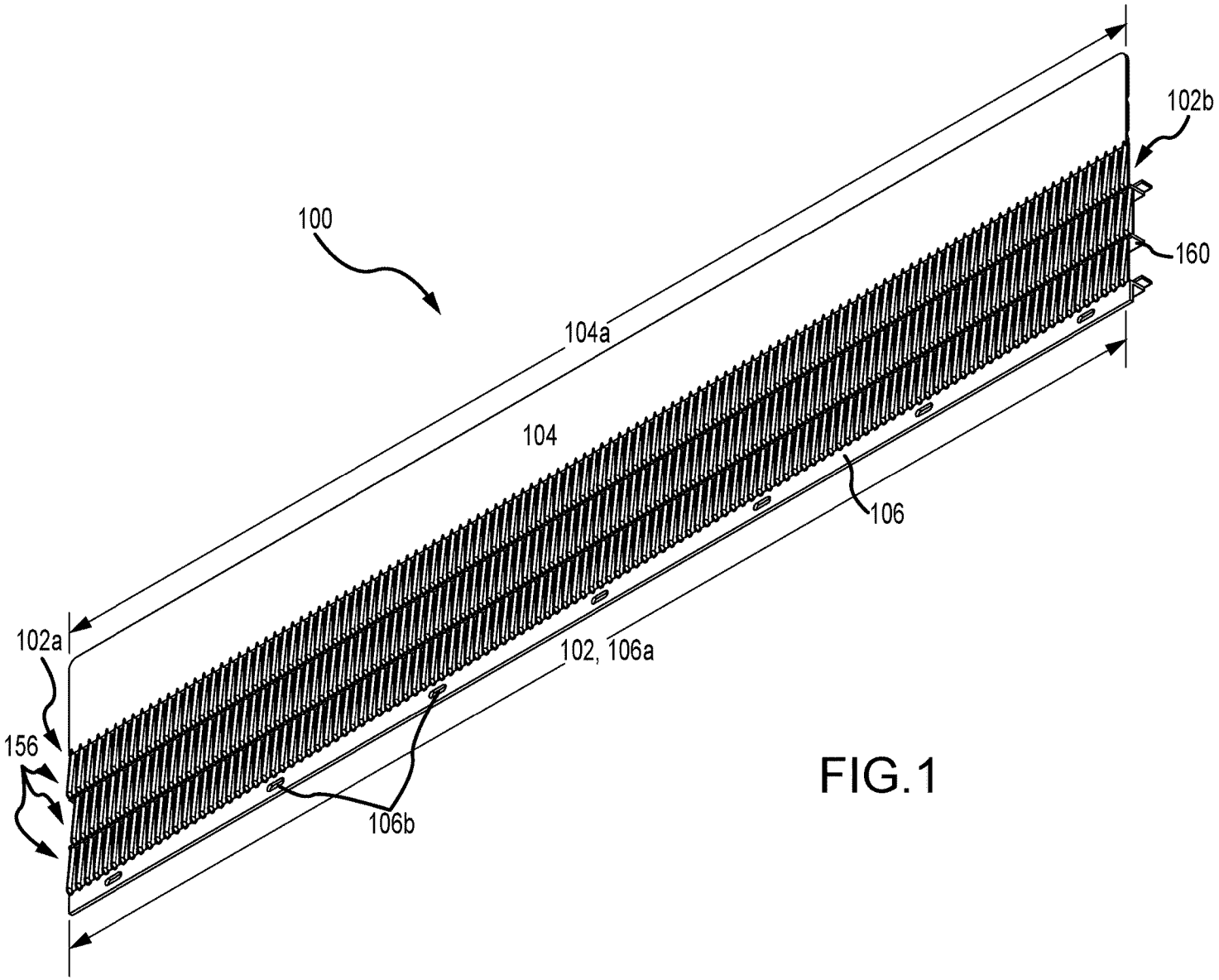
FIG. 1 is a perspective view of a first embodiment of a drainage grate according to the present invention.
Figure 2:
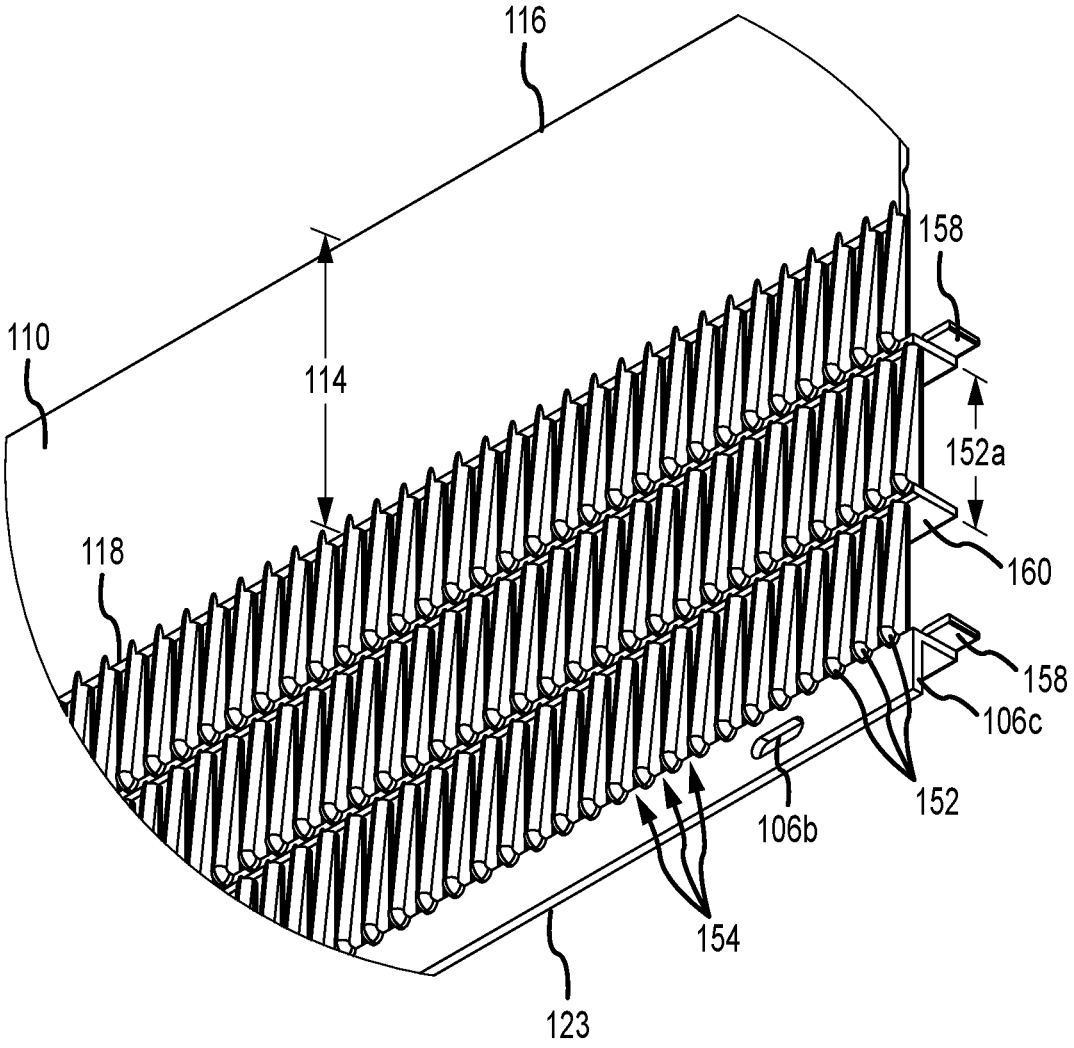
FIG. 2 is an enhanced perspective view of the right end of FIG. 1.
Figure 3:
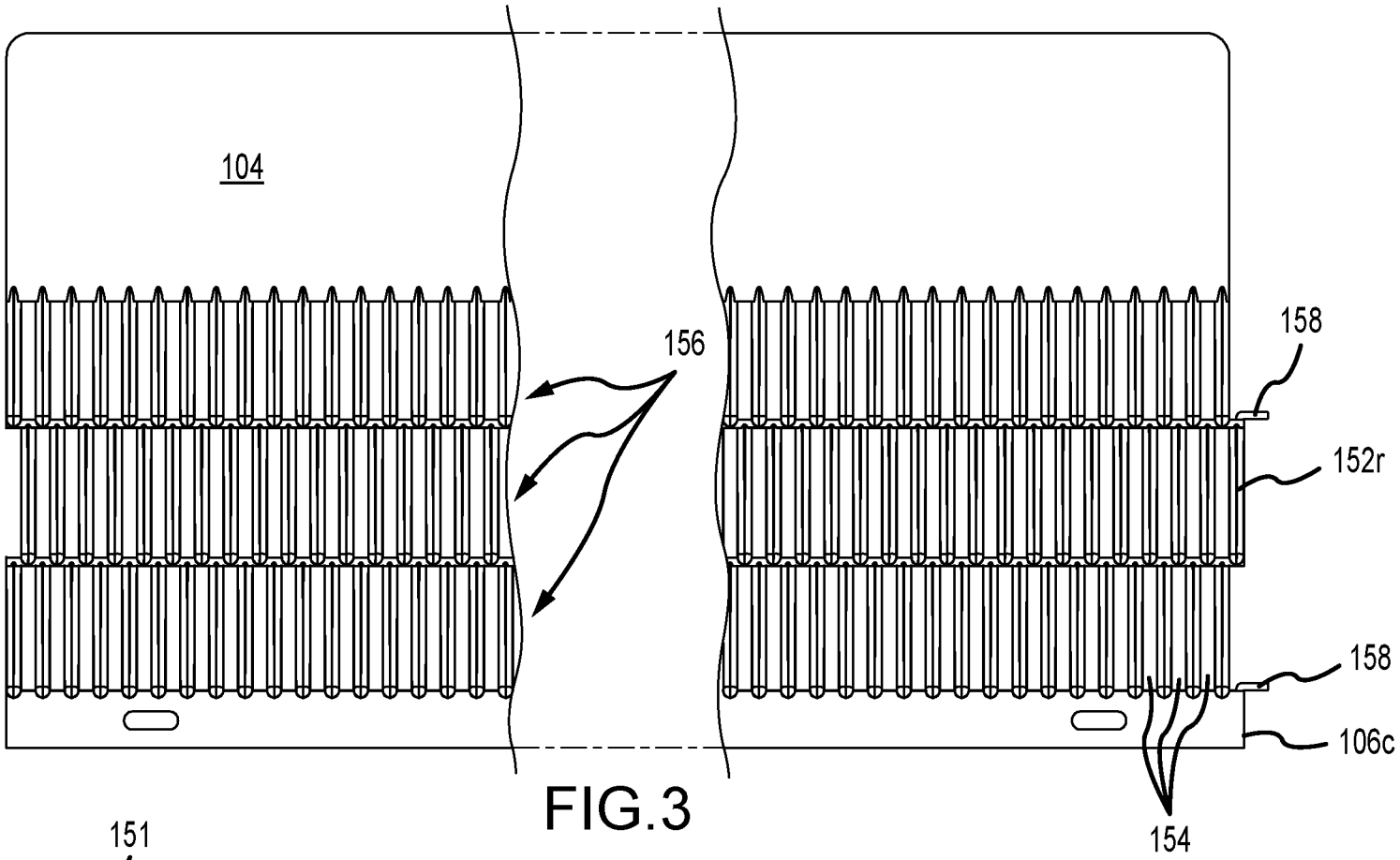
FIG. 3 is a top plan partial cutaway view of the embodiment of FIG. 1.
Figure 6:
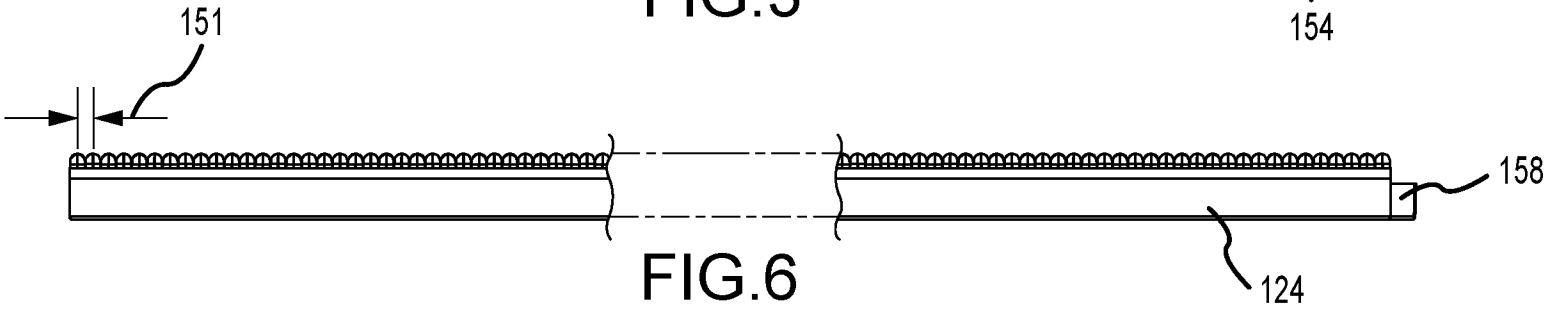
FIG. 6 is a front elevation view of the embodiment of FIG. 3.
Figure 4:
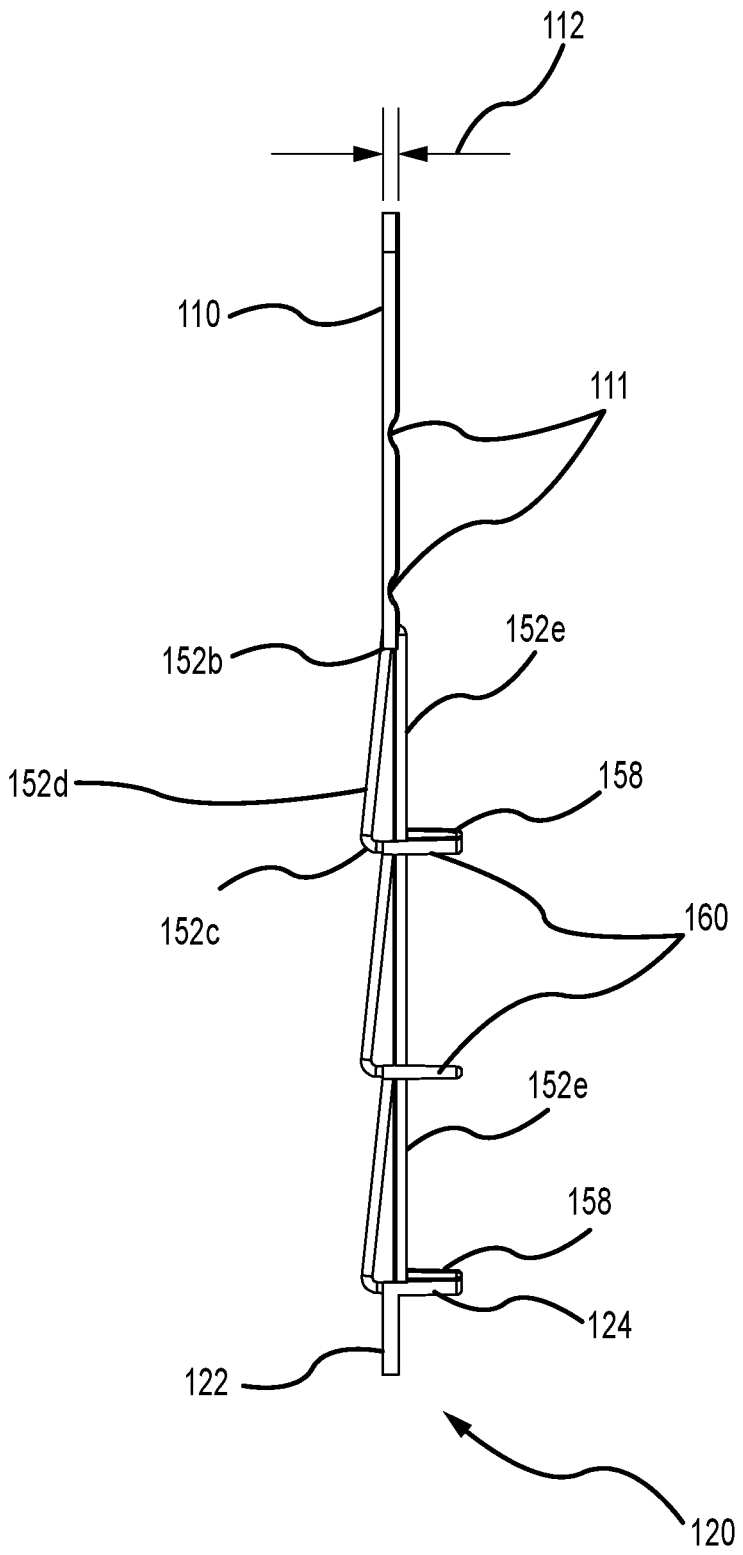
FIG. 4 is a right side elevation view of the embodiment of FIG. 1.
Figure 5:
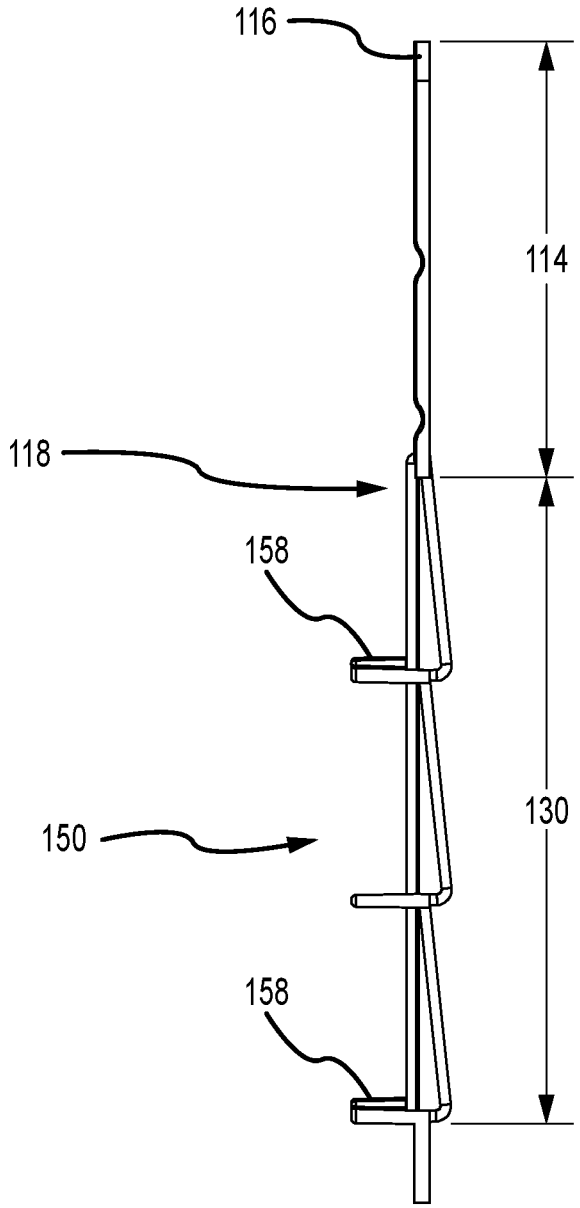
FIG. 5 is a left side elevation view of the embodiment of FIG. 1.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Turning now to FIGS. 1-6, a first embodiment 100 of a liquid drainage grate according to the present invention can be seen. The grate 100 extends along a grate length 102 from and including a first grate end 102*a* and to and including a second grate end 102*b*, which may be a substantially linear length as shown, or at least a length defined along a path that is located between and preferably equidistant from a first support member 104 and a second support member 106 if other shapes (e.g., circular) are utilized for the overall grate. The first support member 104 has a first support member length 104*a*, which is measured parallel or concentrically to the grate length 102. The second support member 106 has a second support member length 106*a*, which is measured parallel or concentrically to the grate length 102, and may approximate or be equal thereto.

The first support member 104 is preferably a substantially planar plate 110 having a substantially consistent thickness 112 throughout a first support member width 114 from a mounting edge 116 to a support edge 118. Additionally or alternatively, the first support member 104 may include one or more stress riser formations 111, such as longitudinal grooves extending preferably along the entire first support member length 104*a*, which may assist in providing enhanced flexibility along such formations 111 to aid in installation, as later described.

The second support member 106 is preferably an angular member 120 having an L-shaped cross-section along at least a portion of (and more preferably along a majority of, and most preferably along the entire) the second support member length 106*a*, the cross-section including a first mounting leg 122 and a beam leg 124. The mounting leg 122 extends substantially parallel to and/or coplanar with the first support member 104. The mounting leg 122 has a free edge 123 facing radially outwardly from the remainder of the grate 100. The mounting leg 122 preferably includes one or more mounting notches, slots or apertures 106*b* formed therethrough. The beam leg 124 depends downwardly from the mounting leg 122, preferably at least partially supporting a plurality of drainage ribs 152 discussed below. While the second support member 106 preferably has an L-shaped cross section, it is to be understood that the mounting leg 122 and the beam leg 124 may not be joined, as the beam leg 124 may be spaced from the mounting leg 122, towards the first support member 104, or even eliminated altogether.

The first support member 104 and the second support member 106 are preferably spaced from each other along the entirety of the grate length 102 by a drainage gap 130. Spanning the drainage gap 130 is a drainage rib structure 150. The drainage rib structure 150 includes a plurality of drainage ribs 152 defining fluid passageways in the interstitial spaces 154 therebetween. The drainage ribs 152 are preferably provided in a plurality of rows 156 to span the drainage gap 130. The rows 156 extend parallel to the grate length 102, but each drainage rib 152 preferably extends along a rib length 152*a* that is not parallel to the grate length 102. The rib length 152*a* preferably extends substantially perpendicular to (or radially through) the grate length 102. In adjacent rows of drainage ribs 152, the ribs 152 are preferably not aligned along their respective rib length 152*a*. That is, there is preferably a rib offset 151 between a median line along a rib 152 in a first row 156 and a medial line along a rib 152 in a second row 156, the second row being adjacent to the first. A preferred rib offset 151 preferably positions ribs 152 in adjacent rows 156 substantially centered along the interstitial spaces 154 of adjacent row(s) 156, thus creating a substantially checkerboard pattern (when viewed from above, as in FIG. 3) of ribs 152 and spaces 154.

Each rib 152 is preferably a solid member, preferably having an at least substantially consistent width (measured parallel to the device length 102), which extends from a rear end 152*b* (closer to the first support member 104) to a front end 152*c* (closer to the second support member 106). Each rib 152 is preferably wedge-shaped, with a shorter height provided at the rear end 152*b* and a taller height, or knee, provided at the front end 152*c*. This height differential provides a discontinuous step arrangement between the first support member 104 and the second support member 106. Though other configurations are contemplated, a top surface 152*d* of each rib is preferably rounded about an axis running parallel to the top surface 152*d* along the rib length 152*a*. A bottom surface 152*e* of each rib 152 is preferably substantially coplanar with bottom surfaces 152*e* of other ribs 152 in the same row 156 and/or preferably substantially coplanar with bottom surfaces 152*e* of ribs 152 in adjacent rows 156, if provided. The described arrangement of ribs 152 preferably provides surface disruption in three dimensions, each of which has been found to be advantageous in promoting liquid drainage. Such surface disruption may also enhance traction if the grate is intended for use in a floor drain or conduit.

While only a single row 156 of ribs 152 may be used, where more than one row 156 of ribs 152 is utilized, adjacent rows 156 are preferably supported by a support beam 160 extending along a support beam length 162. The support beam 160 is preferably spaced at least substantially equidistant from the first support member 104 and/or the second support member 106 along at least a majority of the respective first support member length 104*a* and/or second support member length 106*a*. While the support beam 160 may be indirectly coupled to the first support member 104 and the second support member 106 (e.g., through ribs 152), the support beam 160 is preferably located between and spaced from the first support member 104 and the second support member 106.

Devices 100 according to the present invention may be provided (e.g., in an installation kit package) in a single or variety of lengths 102. Preferably, however, a mating structure is provided to maintain front-to-back and lateral registration of adjacent devices 100 placed along a length of a conduit that may be longer than a single length 102. The mating structure preferably includes registration tabs 158 to nest against and cooperate with the support beam(s) 160 and/or beam leg 124 to assist in front-to-back registration and general device alignment. The mating structure preferably also includes a registration rib 152*r* extending from the same end 102*b* of the device 100 and/or a registration extension 106*c* of the second support member 106. The registration rib 152*r* and extension 106*c* assist in maintaining lateral registration to form a substantially uninterrupted checkerboard pattern of ribs 152 and spaces 154, as previously discussed, as between adjacent devices 100.

To use a device 100 according to the present invention, the rib structure 150 is placed over a liquid conduit, such as a drain pipe, trough or gutter. The device 100 may then be secured to the liquid conduit, itself, or other supporting structure. An example of a preferred liquid conduit to be used in conjunction with a device 100 according to the present invention is a common rain gutter fastened to a building structure, such as a house. Rain gutters are generally thought to be available in a variety of cross-sections, usually referred to as styles or types (Styles A through K, for example). Each style or type of rain gutter, however, generally has a front, rolled or bent edge or lip, and also has a rear mounting flange to be secured to a support structure, such as a roofing facia on a building, and an upward-facing channel extending therebetween of a predetermined width, such as between about 3.5 inches and about 6.5 inches. Devices according to the present invention may be utilized with a variety of gutter cross-sections.

Figure 7:
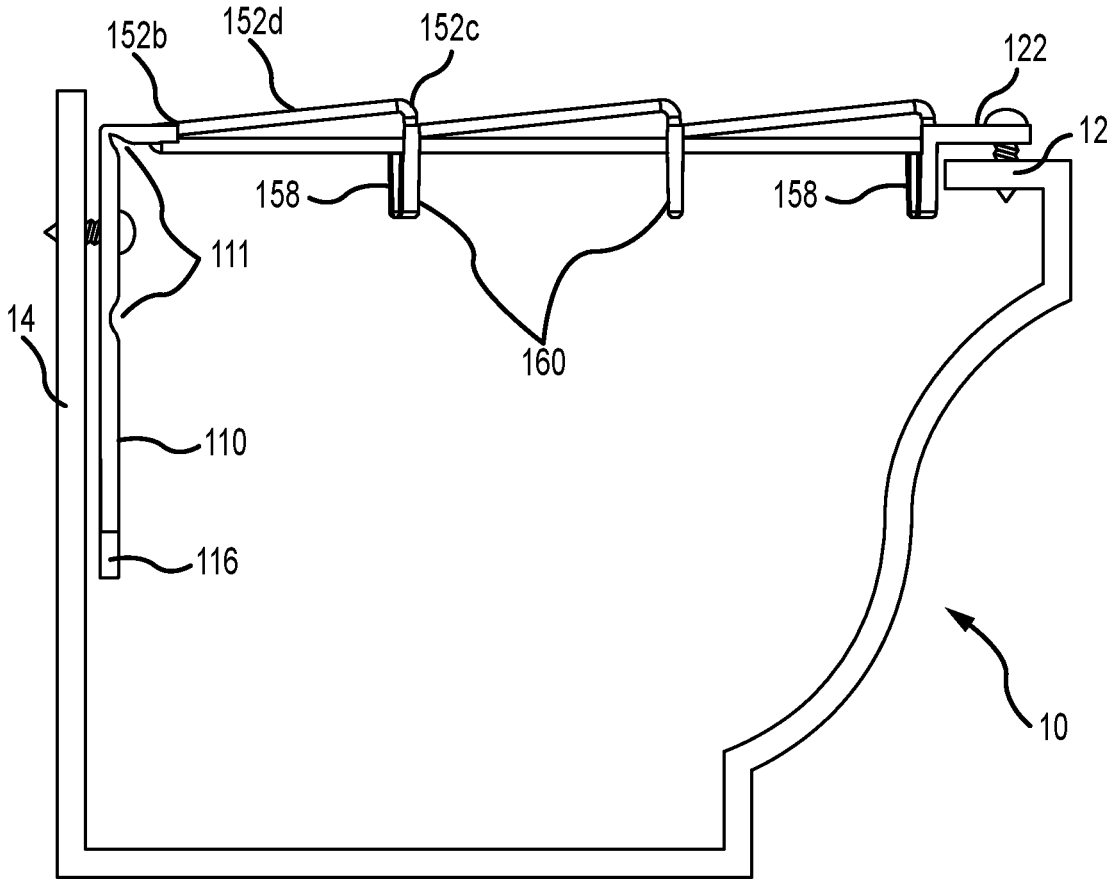
FIG. 7 is a left end elevation view of FIG. 5, in an installation configuration.

Referring now to FIG. 7, to use a device or system according to the present invention, a first device 100 according to the present invention may be positioned over a rain gutter 10 and preferably secured relative thereto. For instance, as shown in FIG. 7, the first support member 104 may be bent (e.g., along a stress riser 111) downwards towards a support beam 160 to or through an angle of approximately sixty degrees to approximately one hundred degrees, and more preferably about ninety degrees. In this way, at least a portion of the first support member 104 may be tucked between the rear gutter mounting flange 14 and support structure (e.g., facia), but the portion is more preferably inserted into the rain gutter 10. The first support member 104 may then be secured to a rear gutter mounting flange 14 (and/or other support structure, such as a facia) by fasteners (e.g. screws). The second support member 106 may be positioned above and/or adjacent to a front, rolled or bent edge or lip 12 of the rain gutter 10, and fasteners (e.g. screws) may be driven through the mounting apertures 106*b* and the gutter edge or lip 12.

The bending of the first support member 104, discussed above, may be avoided, such as when a roofing material proximate to or overhanging the gutter 10 allows for underlayment or overlayment of the first support member 104 relative thereto. For instance, on a structure including asphalt shingles, it may be possible to insert the first support member 104 between those shingles and another roofing layer (e.g., tar paper, roofing substrate (e.g., plywood or oriented strand board (OSB), or another shingle layer), and then fasten only the second support member 106 to the gutter 10, as previously described. In this way, the first support member 104 (or a portion of it) can be held in place (e.g., sandwiched) between one layer of roofing material and another without the need for additional fasteners, though additional fasteners could be used. If the first support member 104 is overlayed (i.e., on top of) all layers of roofing material, To continue installation along a length of gutter 10 that is longer (e.g., between capped gutter ends) than the first installed device 100, a second device 100 according to the present invention may be positioned over the gutter and next to the first device 100, preferably in an abutting relationship, with cooperation of mating registration tabs 158, support beams 160, and/or registration rib(s) 152*r*. The securement of the second device 100 relative to the gutter may then be repeated as was performed for the first device 100. This installation process may be repeated for subsequent devices 100, until a complete longitudinal length of the gutter is covered by one or more devices 100. It may be desirable to trim the length 102 of one of the devices 100 to be installed over the gutter 10, so as to eliminate overhang in the event that the gutter length is not substantially equal to a multiple of the device length 102. Trimming of the length may be performed with a power tool (e.g., cutoff wheel, band saw, etc.) or with hand tools (e.g., aviation snips, side cutters, utility knife, etc.), and may be done at a mitered angle so as to provide an apparent continuous device 100 along an entire length of gutter 10 between capped ends thereof.

Once installed, liquid is free to run either directly into the interstitial spaces 154 (e.g., falling rain directly through grate) or liquid may be received by and flow at least partially across the first support member 104 (e.g., roof or floor runoff) or by ribs 152, and then may flow into the interstitial spaces 154. The surface disruptions caused by the features of devices according to the present invention improve liquid drainage. Additionally, such disruptions may provide additional air passageways to increase likelihood that debris that may come to rest on the device (e.g., on one or more rib top surface(s) 152*d*) is dislodged due to ambient air currents or wind.

Figure 8:
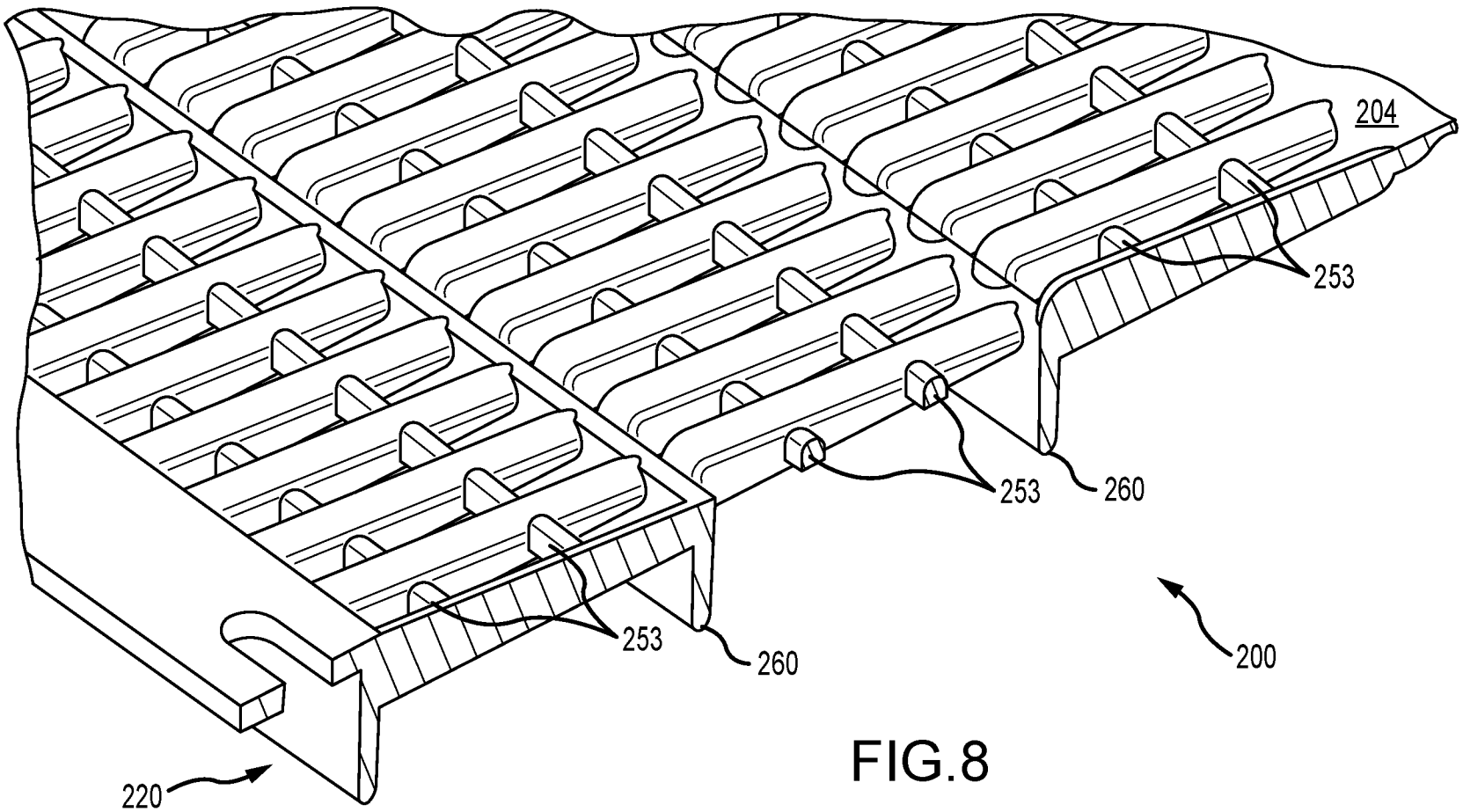
FIG. 8 is a perspective cross-sectional view of a second embodiment of a drainage grate according to the present invention.
Figure 9:
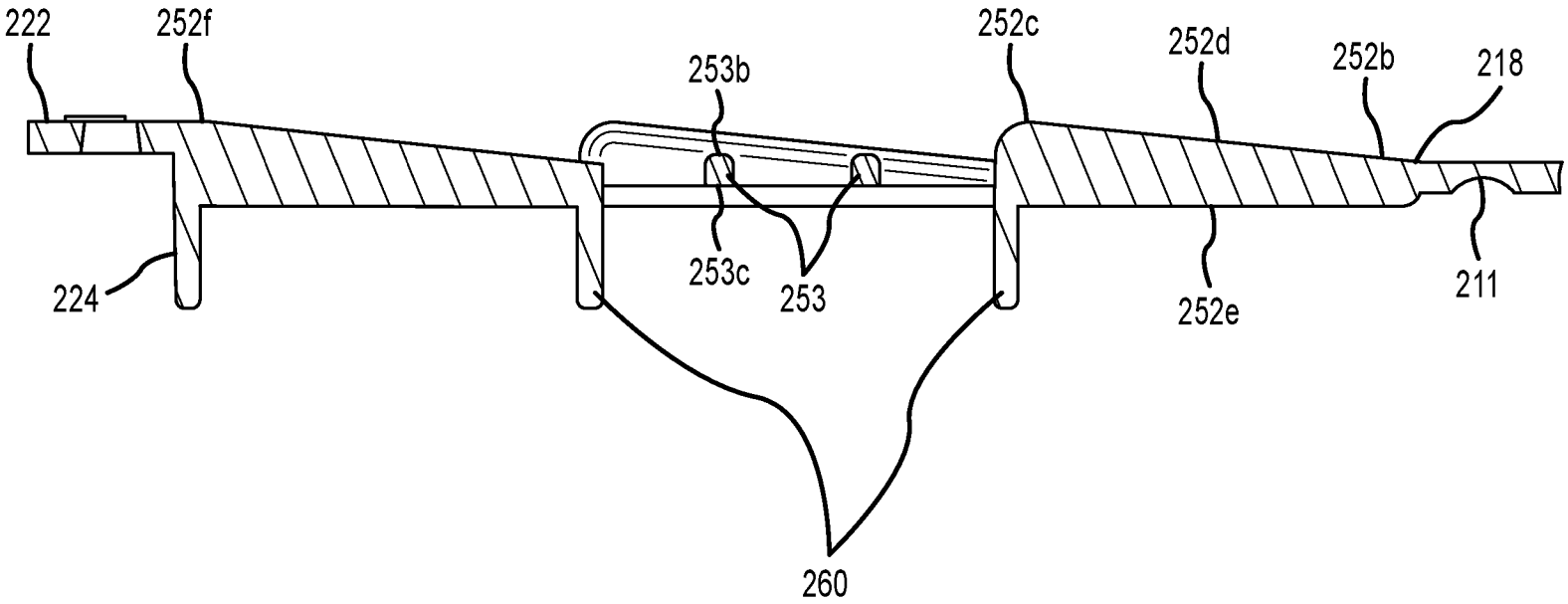
FIG. 9 is an elevational cross-sectional view of the embodiment of FIG. 8.

Turning now to FIG. 8 and FIG. 9, a second embodiment 200 of a liquid drainage grate according to the present invention can be seen. The second embodiment 200 is at least substantially similar to the first embodiment 100 in terms of structure, organization, and installation, such that the above description generally describes the second embodiment 200 as well, and where like numbering refers to identical or substantially similar structure. The second embodiment 200 further includes one or more spacing ribs 253 in the drainage rib structure 250, preferably located between each and every drainage rib 252. The spacing ribs 253 preferably run at least substantially perpendicularly (or radially) to or through the drainage ribs 252 and preferably extend from the first grate end 202*a* to the second grate end 202*b*, and preferably parallel to the grate length 202.

Each spacing rib 253 is preferably a solid member having an at least substantially consistent width (measured perpendicular to the device length (e.g., 102)) along its length (measured parallel to the device length (e.g., 102)). Though other configurations are contemplated, a top surface 253*b* of each spacing rib is preferably rounded (or has rounded edges) about an axis or axes running parallel to the top surface 253*b*, substantially perpendicular to a drainage rib 252. A bottom surface 253*c* of each spacing rib 253 is preferably substantially coplanar with bottom surfaces 253*c* of other spacing ribs 253 in the same row 256 of drainage ribs 252 and/or preferably substantially coplanar with bottom surfaces 253*c* of spacing ribs 253 in adjacent rows 256, if provided.

Liquid drainage devices according to the present invention may be formed of any material suitable to withstand continued exposure to a liquid to be drained. For instance, if water is a primary liquid to be drained, such as water received from a shingled roof, a preferred material may be a high-density polyethylene copolymer having a preferred durometer, such as a Shore D rating of greater than zero to about 80, and more preferably about 65. Whereas, if a liquid to be received by drainage devices according to the present invention are oils, gels, etc., such as in a manufacturing setting, materials such as polyethylene, polypropylene, or polytetrafluoroethylene (PTFE) may be desirable. Drainage devices according to the present invention may be injection molded, cast, CNC machined, etc., as is known in the art.

The foregoing is considered as illustrative only of the principles of the invention. Furthermore, because numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A device comprising:

a first support member having a first support member length;

a second support member spaced at least substantially equidistant from the first support member along at least a majority of the first support member length;

a support beam extending along a support beam length and spaced at least substantially equidistant from the first support member along at least a majority of the first support member length, the support beam being located between and spaced from the first support member and the second support member;

a first plurality of drainage ribs extending from the first support member to the support beam, a majority of the first plurality of drainage ribs having an upper surface extending from a first end coupled to the first support member to a second end coupled to the support beam; and a second plurality of drainage ribs extending from the support beam to the second support member, a majority of the second plurality of drainage ribs having an upper surface extending from a first end coupled to the support beam to a second end coupled to the second support member;

wherein the second end of the upper surface of the majority of the first plurality of drainage ribs terminates in a knee that is positioned at a greater distance from the support beam than the first end of the upper surface of the majority of the second plurality of drainage ribs.

2. A method comprising the steps of:

positioning a grate over a gutter positioned to receive liquid drainage from a roof; and securing the grate relative to the gutter, wherein the grate comprises:

a first support member having a first support member length;

a second support member spaced at least substantially equidistant from the first support member along at least a majority of the first support member length;

a first plurality of spaced drainage ribs extending from the first support member towards the second support member;

a second plurality of spaced drainage ribs extending from the second support member towards the first support member; and a third plurality of spaced drainage ribs extending between and coupled to the first plurality of drainage ribs and the second plurality of drainage ribs, and wherein the positioning step comprises the steps of:

bending the first support member; and inserting the first support member into the gutter.

3. A method according to claim 2, wherein the securing step comprises the step of:

coupling the first support member to the gutter with a mechanical fastener.

4. A method according to claim 2, wherein the first support member comprises at least one stress riser formed along and parallel to the first support member length, the bending step comprising the step of deforming the first support member along one of the at least one stress riser.

5. A method according to claim 4, wherein the at least one stress riser is formed along the entire first support member length.

* * * * *